US010491996B2

(12) United States Patent
De Milleri et al.

(10) Patent No.: US 10,491,996 B2
(45) Date of Patent: Nov. 26, 2019

(54) MICRO-ELECTRO-MECHANICAL SYSTEM (MEMS) CIRCUIT AND METHOD FOR RECONSTRUCTING AN INTERFERENCE VARIABLE

(71) Applicant: Infineon Technologies AG, Neubiberg (DE)

(72) Inventors: Niccolo De Milleri, Villach (AT); Dietmar Straeussnigg, Villach (AT); Andreas Wiesbauer, Poertschach (AT)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 15/879,047

(22) Filed: Jan. 24, 2018

(65) Prior Publication Data

US 2018/0213324 A1 Jul. 26, 2018

(30) Foreign Application Priority Data

Jan. 26, 2017 (DE) ..... 10 2017 101 497

(51) Int. Cl.
*H04R 3/04* (2006.01)

(52) U.S. Cl.
CPC ..... *H04R 3/04* (2013.01); *H04R 2201/003* (2013.01); *H04R 2410/03* (2013.01)

(58) Field of Classification Search
CPC ..... H04R 1/1083; H04R 2460/01; G10L 21/0208; G10L 21/0216; G10L 21/02161; G10L 21/0264; G10K 11/17873; G10K 11/17883; G10K 11/17885; G10K 2210/3226; G10K 2210/3225; G10K 2210/1082; G10K 11/17837; G10K 11/1783; G10K 11/175; G10K 11/1781
See application file for complete search history.

(56) References Cited

U.S. PATENT DOCUMENTS 4,736,432 A 4/1988 Cantrell
6,895,095 B1 * 5/2005 Thomas ..... G10L 21/0208 379/406.12
8,155,334 B2 * 4/2012 Joho ..... G10K 11/178 381/71.12

(Continued)

FOREIGN PATENT DOCUMENTS

DE 19814971 A1 10/1999
WO 2017082974 A1 5/2017

OTHER PUBLICATIONS

Wayback Machine, Wikipedia, "Recursive Filter", May 29, 2014 (Year: 2014).*

*Primary Examiner* — Kile O Blair
(74) *Attorney, Agent, or Firm* — Slater Matsil, LLP

(57) ABSTRACT

A Micro-Electro-Mechanical System (MEMS) circuit and a method for reconstructing an interference variable are provided. The MEMS circuit includes a MEMS device configured to generate a MEMS signal; a control circuit configured to detect a switched-on state or switched-off state of at least one device and configured to generate a control signal at least partly depending on the switched-on state or the switched-off state; a reconstruction filter configured to determine an interference signal that is partly generated by the at least one device, using the generated control signal; and a subtractor configured to subtract the determined interference signal from the MEMS signal.

24 Claims, 6 Drawing Sheets

(56) References Cited

U.S. PATENT DOCUMENTS

| | | | | |
|---|---|---|---|---|
| 9,549,252 | B2 * | 1/2017 | Suvanto | H04R 3/005 |
| 2006/0204025 | A1 | 9/2006 | Paludan-Muller et al. | |
| 2008/0212791 | A1 * | 9/2008 | Asada | G10K 11/178 381/71.6 |
| 2011/0130176 | A1 * | 6/2011 | Magrath | G10K 11/178 455/570 |

* cited by examiner

MICRO-ELECTRO-MECHANICAL SYSTEM (MEMS) CIRCUIT AND METHOD FOR RECONSTRUCTING AN INTERFERENCE VARIABLE

CROSS-REFERENCE TO RELATED APPLICATIONS

This application claims the benefit of German Application No. 102017101497.7, filed on Jan. 26, 2017, which application is hereby incorporated herein by reference in its entirety.

TECHNICAL FIELD

Exemplary embodiments relate to a Micro-Electro-Mechanical System (MEMS) circuit and a method for reconstructing an interference variable.

BACKGROUND

With increasing miniaturization of sensors and sensor systems, for example in the form of a Micro-Electro-Mechanical System (MEMS), increasing importance has to be accorded to interference influence variables, for example on account of a temperature change.

A MEMS accommodated in a housing or an application-specific integrated circuit (ASIC) can be influenced by external influences. A MEMS is a component which combines one or more logic elements and a micromechanical structure in one chip. It can process mechanical and electrical information. ASICs are electronic circuits that are realized as integrated circuits. A MEMS comprises one or a plurality of sensors. The sensor or sensors is or are situated for example in direct proximity to one another and is or are accommodated in a common housing, which is also referred to as a package.

In a case where a plurality of sensors are accommodated in a common package, a mutual influencing of the sensors, for example as a result of a thermal power loss, can occur.

If, in an electronic circuit, a MEMS is situated for example alongside a power amplifier or in the vicinity of an antenna of a mobile telephone, then the measurement signal of the MEMS can be adversely influenced, that is to say that the measurement signal can be corrupted for example by the power amplifier or the antenna.

In this context, mention is also made of "XT" "X talk" or "cross talk". This is a term that generally denotes the undesired influencing of signals which per se are independent of one another.

In particular, during the operation of further electronic components in an electronic component system, a power loss in the form of heat can occur. The emitted heat of one component or of a plurality of components can cause cross-talk with, or be transferred to, the MEMS, for example.

To put it another way, an environment of a sensor of a MEMS is heated as a result of the heat generation of one further component or a plurality of further components. A sensor in a housing (package) can reflect the activity of the at least one component. Ideally, no influencing of the sensor, for example of the MEMS sensor, by the external influences would occur.

If one further component is switched on, for example, then a power loss in the form of heat arises. The power loss is manifested in the form of heat generation, which can lead to a temperature increase in the environment of the at least one device after the at least one component has been switched on. On the other hand, when the at least one further component is switched off, a temperature reduction or a temperature decrease or cooling can occur in the environment of the at least one further device since power loss is no longer generated.

Consequently, a measurement signal provided by the MEMS is corrupted on account of the temperature influencing or temperature change. Said temperature change causes an undesired change in the output signal of a sensor.

The temperature change can lead to incorrect information at the output of the sensor. In this regard, by way of example, in the case of a microphone that is influenced by a temperature change, a heating power of less than 100 W can suffice to cause audible X talk (this may also be referred to as a thermoacoustic effect). The temperature change here is less than 1 mK and cannot usually be measured or used as an input for compensation of the temperature change. A signal purged of a thermal interference variable may be referred to in the present case as a thermal-X talk-compensated signal.

There is thus a need for a MEMS circuit and a method by means of which such temperature influencing or X talk can be kept within a predetermined tolerance range or can possibly even be minimized.

SUMMARY

In accordance with an embodiment, A Micro Electro Mechanical System (MEMS) circuit includes a MEMS device configured to generate a MEMS signal; a control circuit configured to detect a switched-on state or switched-off state of at least one device and configured to generate a control signal at least partly depending on the switched-on state or the switched-off state; a reconstruction filter configured to determine an interference signal that is partly generated by the at least one device, using the generated control signal; and a subtractor configured to subtract the determined interference signal from the MEMS signal.

In accordance with another embodiment, a method for reconstructing an interference variable includes capturing a Micro Electro Mechanical System (MEMS) signal using a MEMS; detecting a switched-on state or a switched-off state of at least one device using a control circuit; generating a control signal using the control circuit, wherein generating the control signal at least partly depends on the switched-on state or switched-off state; determining an interference signal using a reconstruction filter in response to the generated control signal, wherein the determined interference signal models interference generated by at least one device; and subtracting the determined interference signal from the MEMS signal.

BRIEF DESCRIPTION OF THE DRAWINGS

Some embodiments of devices and/or systems and/or methods that serve as an example are explained in greater detail below merely as an example and with reference to the appended figures, in which.

DETAILED DESCRIPTION OF ILLUSTRATIVE EMBODIMENTS

In the following detailed description, reference is made to the accompanying drawings, which form part thereof and which show for illustration purposes specific embodiments in which the invention can be implemented. In this regard, direction terminology such as, for instance, "at the top", "at the bottom", "at the front", "at the back", "front", "rear", etc., is used with regard to the orientation of the figure(s) described. Since components of embodiments can be arranged in a number of different orientations, the direction terminology serves for illustration and is not restrictive in any way whatsoever.

It goes without saying that other embodiments can be used and structural or logical changes can be made, without departing from the scope of protection of the various exemplary embodiments. It goes without saying that the features of the various exemplary embodiments described herein can be combined with one another, unless specifically indicated otherwise.

The following detailed description should therefore not be interpreted in a restrictive sense, and the scope of protection of the present invention is defined by the appended claims. In the figures, the thicknesses of lines, layers and/or regions may be exaggerated for reasons of clarity.

Even though further exemplary embodiments may accordingly have various modifications and alternative forms, some embodiments thereof serving as an example are illustrated by way of example in the figures and are described in detail here. It goes without saying, however, that the intention is not to limit embodiments serving as an example to the specific forms disclosed, rather on the contrary exemplary embodiments serving as an example are intended to cover all modifications, equivalent configurations and alternatives that fall within the scope of protection of the invention. In the description of the figures, identical numerals refer to identical or similar elements.

In the context of this description, the terms "connected" and "coupled" are used to describe both a direct and an indirect connection, and a direct or indirect coupling. In the figures, identical or similar elements are provided with identical reference signs, insofar as this is expedient.

The terminology used here serves only to describe specific embodiments serving as an example and is not intended to have a limiting effect for further embodiments serving as an example. Here the singular forms "a", "an" and "the" are also intended to include the plural forms, unless clearly indicated otherwise in the context. It should furthermore be noted that the terms "comprises", "comprising", "has" and/or "having", if used here, specify the presence of mentioned features, integers, steps, operations, elements and/or components, but do not exclude the presence or addition of one or more other features, integers, steps, operations, elements, components and/or groups thereof.

Figure 1:
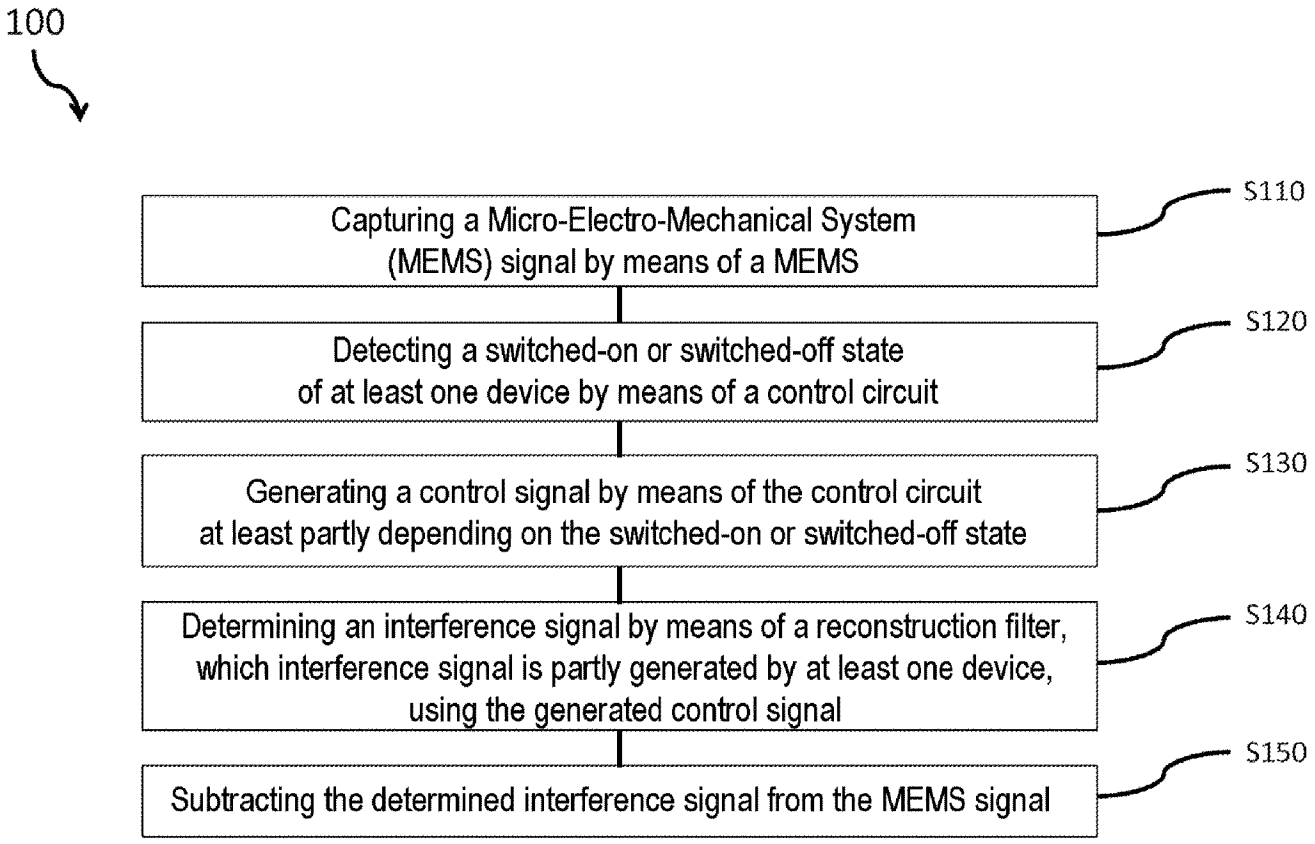
FIG. 1 shows a flow diagram of a method for reconstructing an interference variable in accordance with various exemplary embodiments.

FIG. 1 shows a flow diagram of a method 100 for reconstructing an interference variable in accordance with various exemplary embodiments.

The method can comprise capturing a MEMS signal by means of a MEMS (S110), detecting or receiving a switched-on or switched-off state of at least one device by means of a control circuit (S120), generating a control signal by means of the control circuit at least partly depending on the switched-on or switched-off state (S130), determining an interference signal by means of a reconstruction filter, which interference signal is at least partly generated by at least one device, using the generated control signal (S140), and subtracting the determined interference signal from the MEMS signal (S150).

The method described with respect to FIG. 1 can be carried out in various exemplary embodiments of MEMS circuits described by way of example herein.

In various exemplary embodiments, a MEMS signal can be captured by means of a MEMS. In this regard, by way of example, a temperature, noises by means of a microphone, a pressure, an acceleration or a torque can be measured and provided as an output signal for example to an amplifier for amplifying the signal.

In various exemplary embodiments, at least one item of information can comprise a switched-on or switched-off state of at least one device. By way of example, by means of a control circuit it is possible to register whether a device, for example a power amplifier or an antenna in a mobile telephone, is active or in operation or whether a device is inactive or not in operation. Depending on the registered state, the control circuit can generate a signal by means of which the reconstruction filter can be activated or deactivated. In this regard, by way of example, if operation or an activity of a device is registered by means of the control circuit, a signal can be transmitted to the reconstruction filter. The reconstruction filter receives the signal from the control circuit and, depending on the received signal, reconstructs a reconstruction signal of an interference signal generated by the at least one device. The signal reconstructed by means of the reconstruction filter can then be subtracted from a measurement signal by means of the subtractor.

Detecting at least one item of information can be for example receiving a switched-on or switched-off state of a device, which can be arranged in the vicinity of the sensor used to capture a measurement signal.

In this regard, the at least one device can be arranged within or outside a package. Furthermore, by means of the detecting or receiving, it is possible to register a switched-on or switched-off state of a device that can be arranged on the user side or sensor externally.

In various exemplary embodiments, what can be achieved is that a reconstruction of an interference signal is performed only if an interference variable of a device is present. In the absence of an interference variable, for example emission of heat as a result of operation or activation of a device, the reconstruction cannot be performed. Energy of the overall system can be saved as a result.

In various exemplary embodiments, what can be achieved is that a reconstruction can be carried out adaptively, for example to the devices respectively causing an interference variable.

In various exemplary embodiments, what can be achieved is that the method is carried out on the user side or on a user-side electronic circuit or externally with respect to the microphone, or for example in a microphone, in a temperature sensor, in a gas sensor, or in a pressure sensor.

In various exemplary embodiments, what can be achieved is that not just one item of information is detected or received by means of a control circuit, but rather a plurality of items of information, which leads to an increase in an adaptability of the system to a plurality of interference variables present during operation of a plurality of devices.

In various exemplary embodiments, what can be achieved by means of generating a reconstructed interference signal is that a proportion of a measurement signal that is constituted by an interference variable can be reduced to a predetermined range.

Generating a control signal can be realized by means of the control circuit at least partly depending on the switched-on or switched-off state. In this regard, a control signal can be generated even without a process of detecting or receiving a switched-on or switched-off state of at least one device by means of the control circuit.

By way of example, the control circuit cannot generate a signal to the reconstruction filter upon a first activation of a device being detected or received, rather the control circuit can generate a control signal to the reconstruction filter only upon a further or repeated activation of a device.

A damping of interference variables in a range of approximately 5 dB to approximately 25 dB, of approximately 10 dB to approximately 20 dB, preferably approximately 15 dB, can be achieved by means of the method.

A substantial compensation of the interference variable can be achieved by means of subtracting a reconstructed interference signal from the measurement signal superimposed with the interference signal. An independence of a measuring system from ambient influences can thus be achieved.

Subtracting the determined interference signal from the MEMS signal can be realized by means of a digital subtractor.

Figure 2:
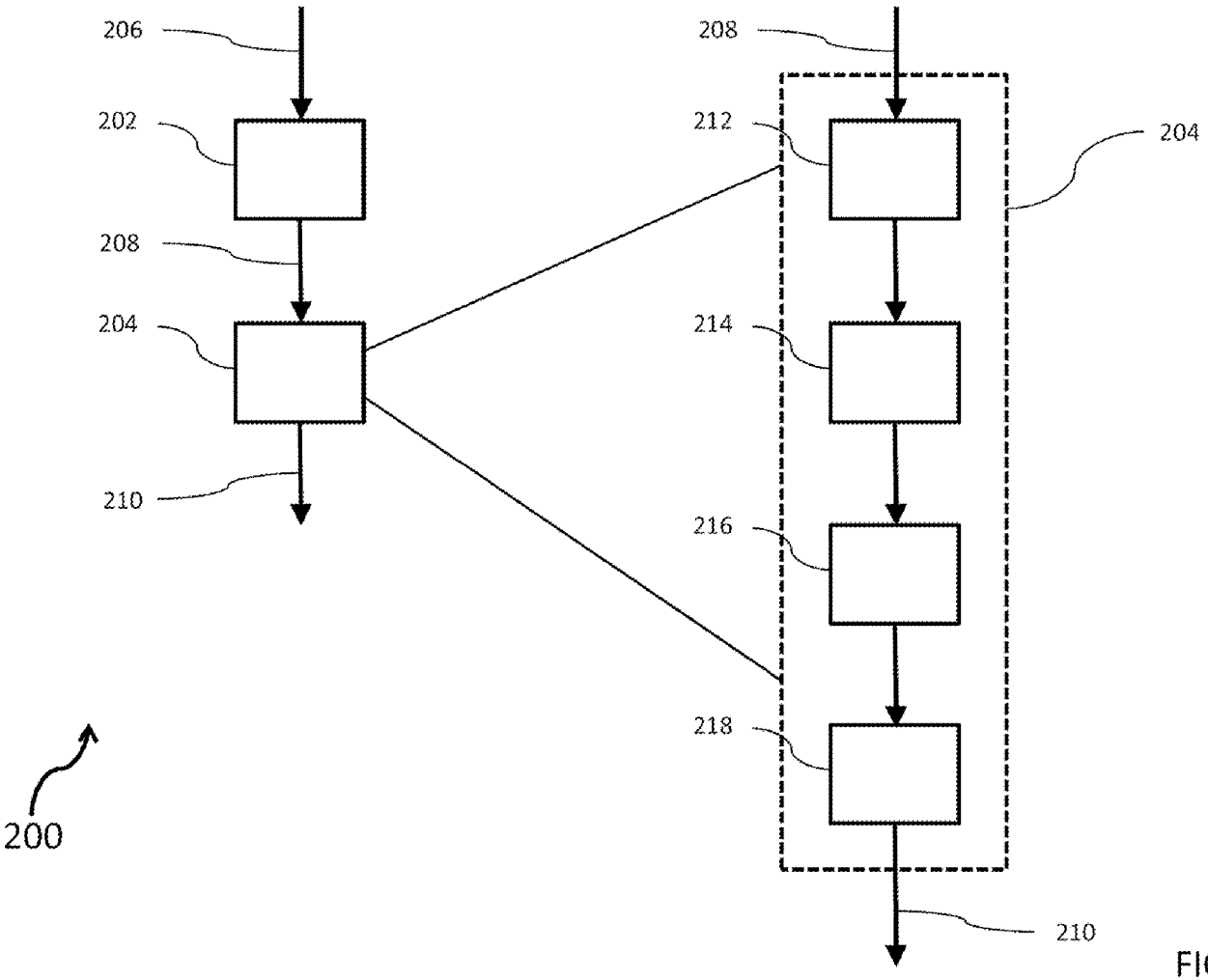
FIG. 2 shows a block diagram of a control circuit and of a reconstruction filter in accordance with various exemplary embodiments.

FIG. 2 shows a block diagram 200 of a control circuit and of a reconstruction filter in accordance with various exemplary embodiments.

The control circuit 202 can detect or receive information 206, which can comprise internal information, for example information about a switch-on or switch-off state of a further sensor in a package, and/or external information, for example information about the switch-on or switch-off state of a radio-frequency amplifier arranged at a distance. Depending on the information 206, the control circuit 202 forwards a signal 208, for example a control signal, to the reconstruction filter 204. If information about a switch on state of a device, for example of a sensor, is present, then the control circuit 202 generates the signal 208.

Furthermore, the control circuit 202 can be configured to generate the signal 208 for a predefined time, assuming 10 seconds for example, independently of at least one external information item. In this regard, by way of example, after detection of a transition from a switched off state to a switched-off state of at least one device or sensor, the control circuit 202 can continue to generate the signal 208 until the sensor, for example the microphone, has a predefined temperature in the course of a cooling process.

The reconstruction filter 204 receives the signal 208. After the reconstruction of the respective interference variable by means of the reconstruction filter 204, the reconstruction filter 204 can provide a signal 210 at an output.

The reconstruction filter 204 can comprise an amplifier 212, a second-order digital filter 214, a first-order high-pass filter 216 and an adaptive FIR filter 218, as is illustrated by way of example on the right hand side in FIG. 2.

In the case of the reconstruction filter 204, an output signal of the amplifier 212 can serve as an input signal for the second-order digital filter 214 and an output signal of the second-order digital filter 214 can serve as an input signal for the first-order digital high-pass filter 216. Furthermore, an output signal of the digital filter 216 can serve as an input signal of the adaptive filter 218. However, other circuit set ups or couplings of components of the reconstruction filter 204 are also possible.

The second-order digital filter 214 can be described in various exemplary embodiments by the equation:

$$Hth = \frac{b_0 + b_1 z^{-1} + b_2 z^{-2}}{1 + a_1 z^{-1} + a_2 z^{-2}}$$

The first order high pass filter 216 can be described by the equation:

$$Hhp = \frac{b_{hp0} - b_{hp1} z^{-1}}{1 + a_{hp1} z^{-1}}$$

In various exemplary embodiments, the adaptive FIR filter 218 can be described by the equation:

$$\mathrm{Fir} = c_0 + c_1 z^{-1}$$

The identifiers ax, $b_x$ and $c_x$ represent coefficients of the respective filter and $z^{-x}$ represent delay elements of the respective filter.

After passing through the reconstruction filter 204, the signal 210 is provided for example to a subtractor, wherein the signal 210 can be a reconstructed signal based on inherent switching of a further device.

In various exemplary embodiments, the reconstruction filter 204 can comprise an amplifier 212, a second-order digital filter 214 and a first order high pass filter 216, wherein no adaptive filter need be provided.

In various exemplary embodiments, the input signal 206 can indicate whether at least one further device, for example a pressure sensor, a gas sensor, a temperature sensor or a microphone, is or has been switched on or off besides the sensor provided for measuring a measurement variable in the MEMS.

In various exemplary embodiments, the amplifier 212 can be provided in order to specify a gain factor of the amplifier 212 during the reconstruction of an interference variable. The gain factor of the amplifier 212 can be dependent on the at least one device in operation. The power consumption can be different from device to device, which can be taken into account by means of the gain factor of the amplifier 212 during the reconstruction. In this regard, by way of example, a power consumption of a pressure sensor may be greater than a power consumption of a microphone, and vice versa.

The second-order digital filter 214 can be modeled for example by means of an IIR filter and constitutes the thermal component in the reconstruction filter 204.

The first order digital high pass filter 216 can be provided in order to model the acoustic properties. The first-order high pass filter 216 can allow the high frequency constituents in the output signal of the second-order digital filter 214 to pass, while low frequency constituents in the output signal of the second-order digital filter 214 can be filtered out.

Figure 3:
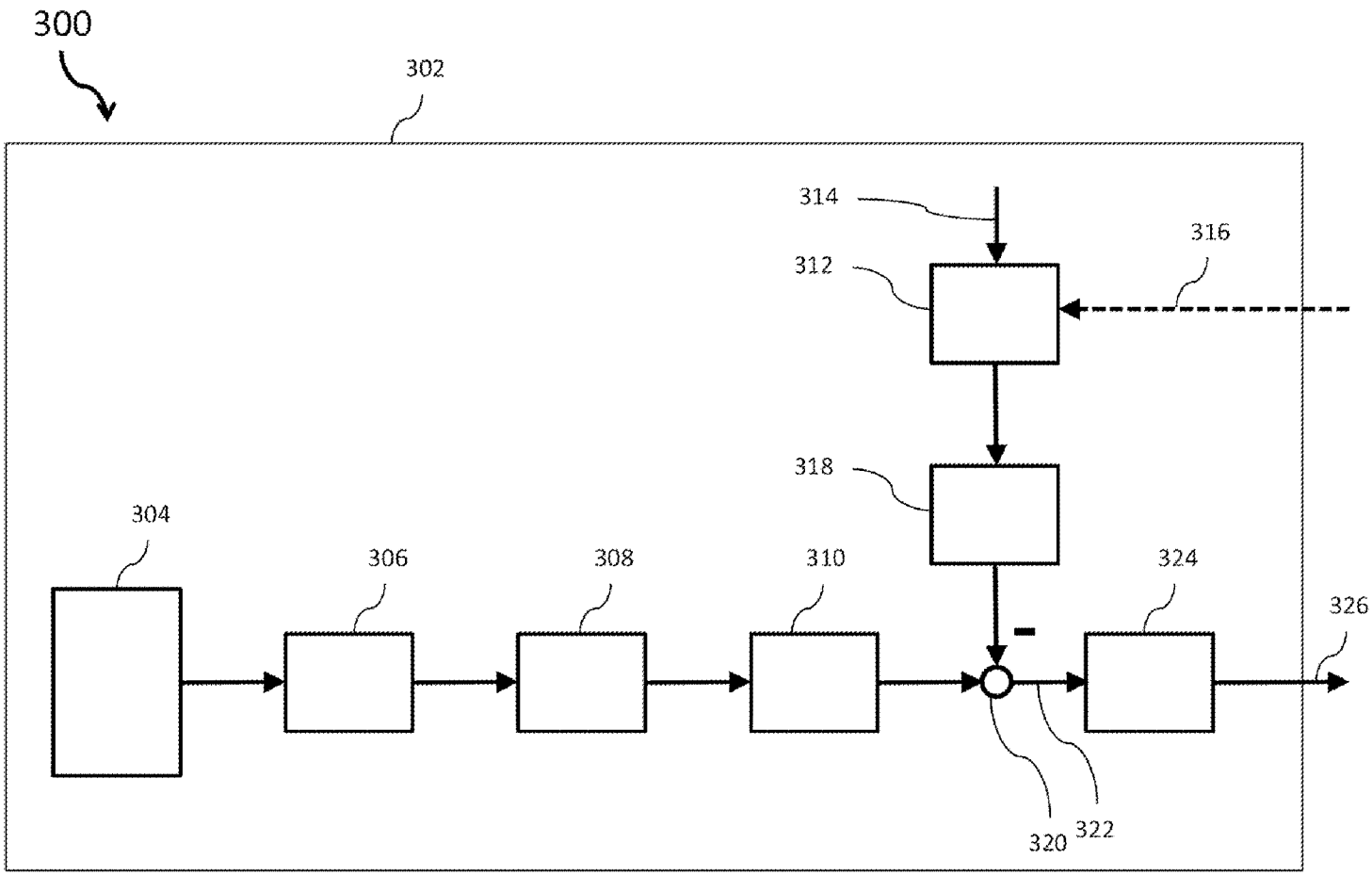
FIG. 3 shows a block diagram of a Micro-Electro-Mechanical System (MEMS) circuit in accordance with various exemplary embodiments.

FIG. 3 shows a block diagram 300 of a MEMS circuit in accordance with various exemplary embodiments.

Illustratively, a MEMS circuit 302 comprising a MEMS device 304, a control circuit 312, a reconstruction filter 318 and a subtractor 320 is provided. The MEMS circuit 302 can comprise a reconstruction filter 318 illustrated with reference to FIG. 2. The reconstruction filter 318 can comprise an adaptive filter as described with reference to FIG. 2. However, the reconstruction filter 218 can also be realized without the adaptive filter.

In the case of the reconstruction filter 318, by means of a method it is possible to provide a signal which can compensate for an interference variable that may be brought about for example as a result of a temperature change, i.e. a temperature increase or a temperature decrease. The exemplary embodiment illustrated in FIG. 3 can be realized in such a way that the reconstruction filter 318 is provided on a microphone side, to put it another way in a microphone.

The MEMS circuit 302 can be a digital microphone, for example, which can output a measurement signal, for example. The MEMS device 304 can comprise for example a microphone membrane, for example a micro electro mechanical membrane, for picking up audio signals. The membrane is deflected from a rest position by means of sound inducted pressure fluctuations and in the process generates an analog signal, which is amplified by an amplifier 306, for example a voltage follower or a source follower. The analog output signal of the amplifier 306 is converted into a digital signal by an analog-to-digital converter 308 and fed to a digital low-pass filter 310. The digital low-pass filter 310 filters out high frequency, digital signals from the digital signals provided by the analog-to-digital converter 308.

If, by way of example, internal information 314 or external information 316 about a switch on or switch off state of at least one device is captured by means of the control circuit 312, then the control circuit 312 forwards a signal to the reconstruction filter 318. If the signal of the control circuit 312 is received by the reconstruction filter 318, then a reconstruction of the interference signal can be realized. The respective reconstructed signal generated can be subtracted from the signal provided by the low-pass filter 310 by means of the subtractor 320, such that a thermal X talk compensated signal 322 is provided, for example. The subtracting is illustrated by a minus sign at the subtractor 320 in FIG. 3. The X talk compensated signal 322 that results after the subtraction can be fed to a modulator 324. The modulator 324 can superimpose two different signals and can provide a user specific 1-bit signal 326, for example. The reconstruction filter 318 can comprise the components that have been described with reference to the further exemplary embodiments.

Figure 4:
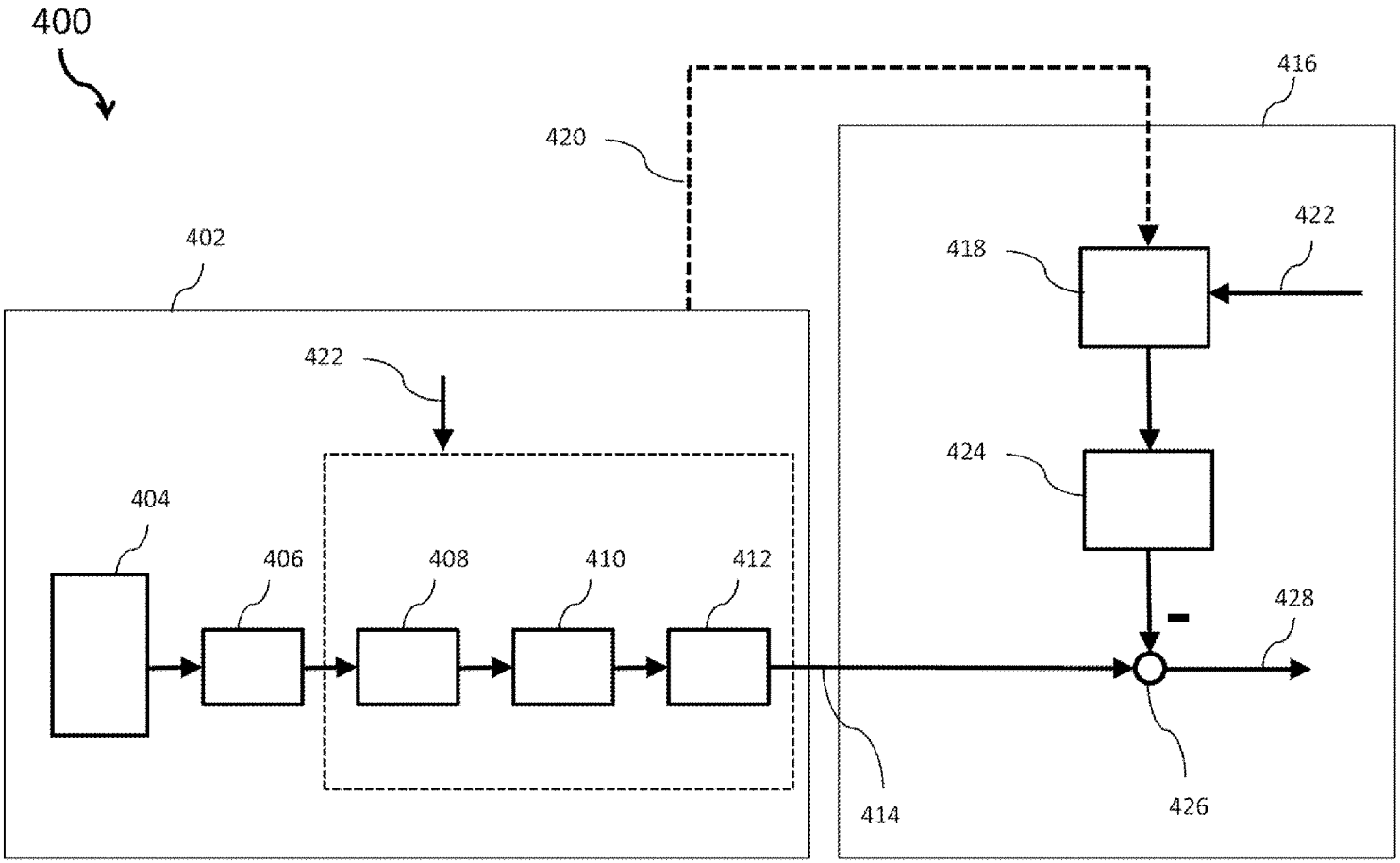
FIG. 4 shows a block diagram of a Micro-Electro-Mechanical System (MEMS) circuit in accordance with various exemplary embodiments.

FIG. 4 shows a block diagram 400 of a MEMS circuit in accordance with various exemplary embodiments.

The MEMS circuit comprises a microphone side 402 and a user-side electronic circuit 416. The exemplary embodiment illustrated in FIG. 4 can be realized in such a way that the control circuit 418 and the reconstruction filter 424 are provided on a user-side electronic circuit 416, to put it another way sensor externally or MEMS externally.

The MEMS device can comprise a digital microphone. A measurement variable can be picked up by means of the MEMS device 404 and fed in the form of an analog signal to an amplifier 406, for example a voltage follower. The amplifier 406 amplifies the signals fed to it and outputs amplified signals. An analog-to-digital converter 408 can receive the amplified analog signals and convert them into digital signals. The digital signals can be fed to a digital low-pass filter 410. The low-pass filter 410 can filter high frequency constituents of the signals out of the latter and forward the filtered signal to a modulator 412. The analog-to-digital converter 408, the digital low-pass filter 410 and the modulator 412 can be realized in the digital microphone and be clocked by means of a sampling rate, for example in a range of approximately 2 MHz to approximately 4 MHz, for example at approximately 3 MHz. The signals 414 leaving the modulator 412 at an output can be 1-bit signals or else multi bit signals.

The 1-bit signals 414 are transmitted from the microphone to the user-side electronic circuit 416. A reconstruction of the interference signal and a subtraction of the reconstructed signal can take place on the user-side electronic circuit 416. In this regard, by way of example, a thermal X talk compensated signal can be provided on the user side, for example sensor externally or MEMS externally.

The reconstruction filter 424 can comprise the components that have been presented with reference to the further exemplary embodiments. The reconstruction filter 424 can be provided on the user-side electronic circuit 416, in the manner as illustrated by way of example in FIG. 4. The external information 420 can be provided, for example optionally, by the external microphone. The internal information 422 can be provided by a user-side electronic circuit or externally with respect to the microphone. The items of information 420 and 422 can be detected or received by the control circuit 418. The reconstruction filter 424 receives the output signals of the control circuit 418 and reconstructs the respective interference variable of the at least one device. The reconstructed signal is provided by the reconstruction filter 424 and subtracted from the signal, for example a 1-bit signal 414, by means of the subtractor 426. The measurement signals 428 purged of the interference variable can then be provided in the user-side electronic circuit 416.

Figure 5:
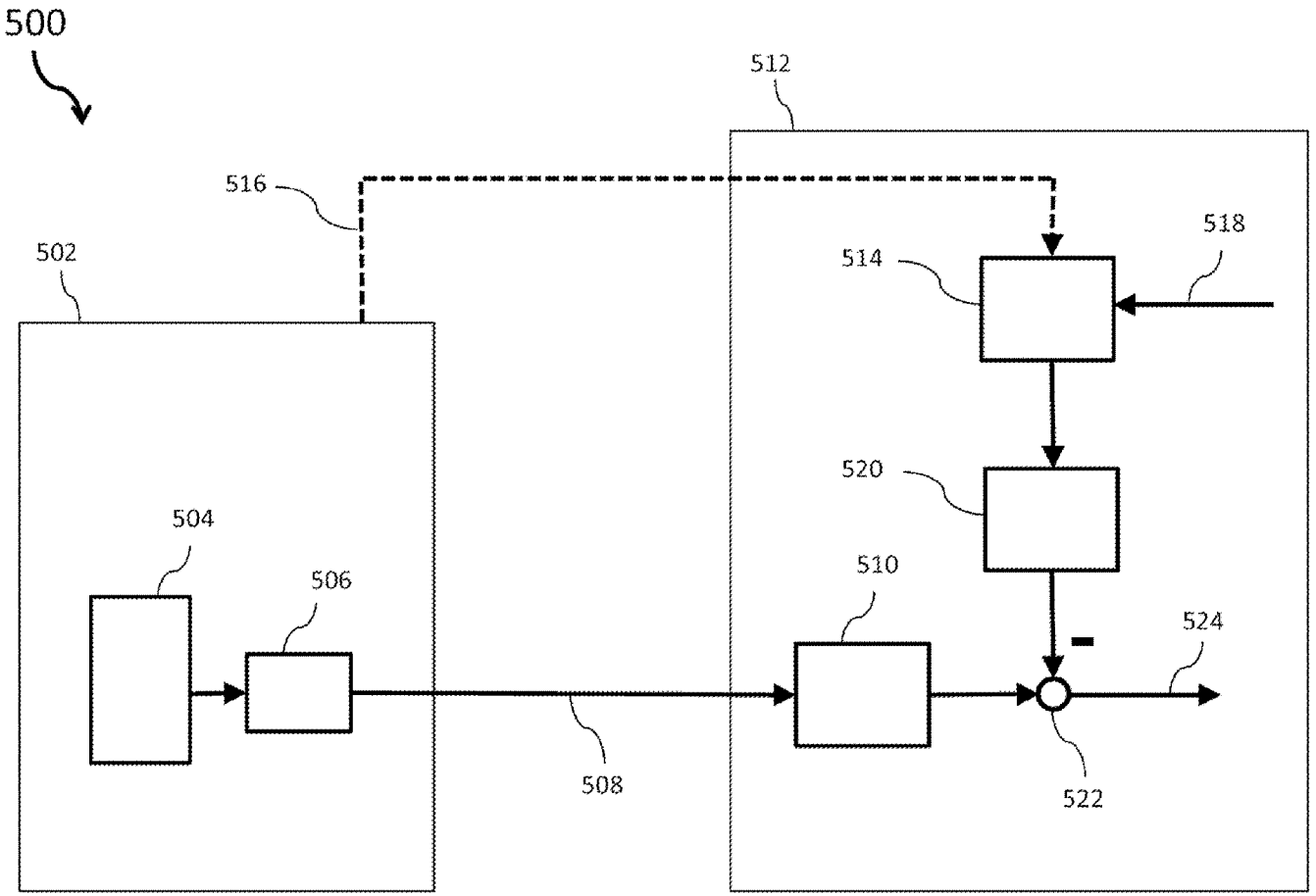
FIG. 5 shows a block diagram of a Micro-Electro-Mechanical System (MEMS) circuit in accordance with various exemplary embodiments.

FIG. 5 shows a block diagram 500 of a MEMS circuit in accordance with various exemplary embodiments.

The MEMS circuit comprises a microphone side 502 and a user-side electronic circuit 512. The exemplary embodiment illustrated in FIG. 5 can be realized in such a way that the control circuit 514 and the reconstruction filter 520 are provided on a user-side electronic circuit 512 of the MEMS circuit, to put it another way sensor externally or MEMS externally.

In the case of the exemplary embodiment illustrated in FIG. 5, the interference variable can be reconstructed on the user-side electronic circuit 512 and the subtraction of the reconstructed signal from the signal beset by interference can take place on the user-side electronic circuit 512.

The MEMS device 504 can comprise an analog microphone. The amplifier 506 can for example be a voltage follower or comprise a voltage follower. The amplifier 506 can amplify the measurement signals of the MEMS device 504 and provide an amplified signal 508 to an analog-to-digital converter 510 arranged on the user-side electronic circuit 512. The signals 508 can be transmitted to the analog-to-digital converter 510 from the amplifier 506 in a wired or wireless manner. The analog-to-digital converter 510 can convert the received analog signals 508 into a digital signal and can output digital signals.

The control circuit 514 can for example detect external information 516 on the microphone side 502 of the MEMS circuit or receive it from the microphone side 502 and/or detect user side internal information 518 or receive it as input signals, as is illustrated by way of example in FIG. 5.

The signals output by the amplifier 506 can be communicated to the analog-to-digital converter 510 in a wired or wireless manner.

The reconstructed signal provided by the reconstruction filter 520 can be subtracted from the signal provided by means of the analog-to-digital converter 510 by means of the subtractor 522. In this regard, by way of example, a thermal X talk compensated signal 524 can be provided on the user-side electronic circuit 512 of the MEMS circuit. The reconstruction filter 520 can comprise the components which have been described with reference to the further exemplary embodiments.

Figure 6:
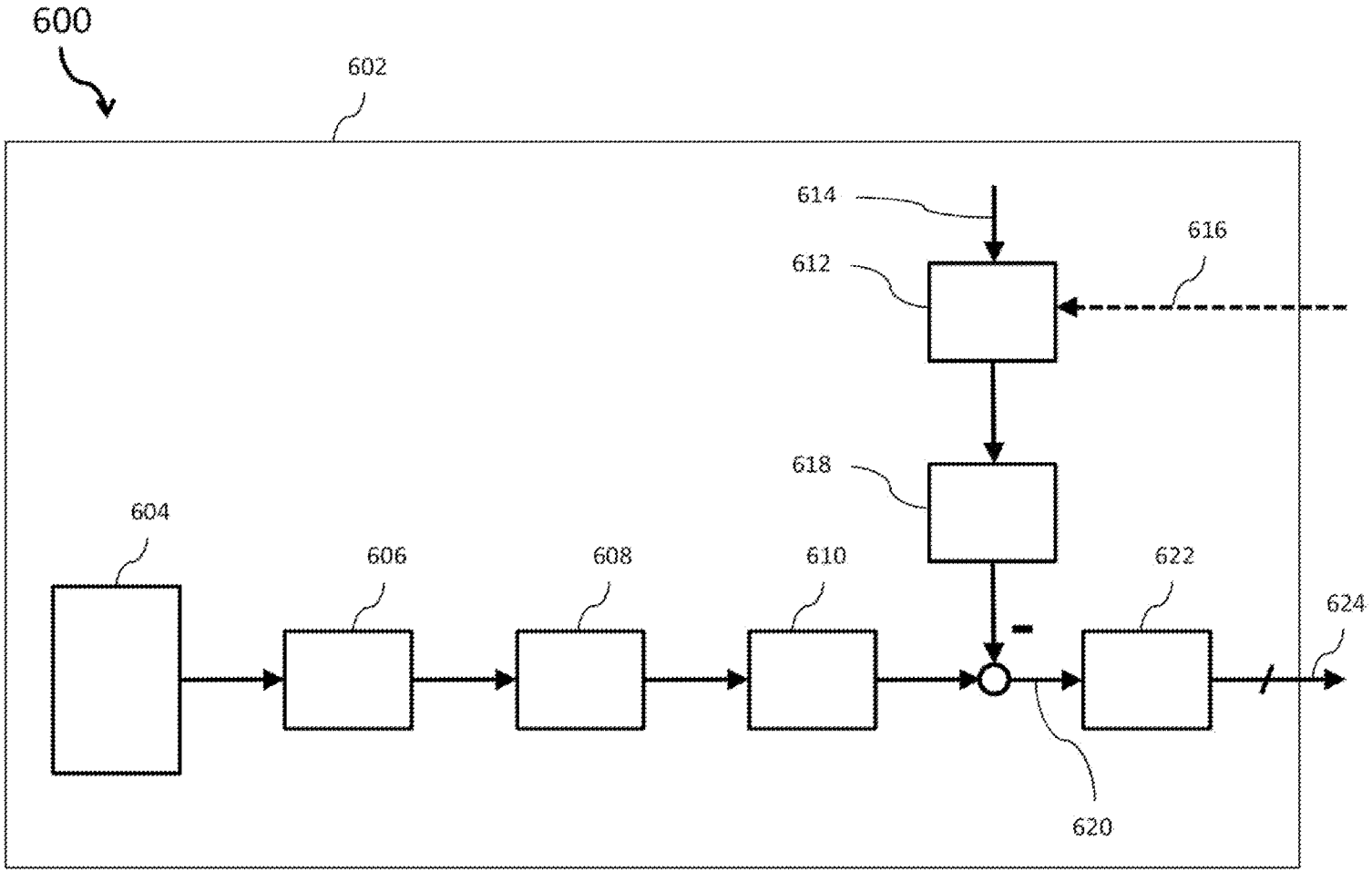
FIG. 6 shows a block diagram of a Micro-Electro-Mechanical System (MEMS) circuit in accordance with various exemplary embodiments.

FIG. 6 shows a block diagram 600 in accordance with various exemplary embodiments.

The MEMS circuit 602 can comprise a MEMS device 604, a filter 606, an analog-to-digital converter 608, a decimation filter 610, a control circuit 612, a reconstruction filter 618 and an interface 622. The MEMS device 604 can comprise a digital microphone. The control circuit 612 can detect or receive internal information 614 and external information 616. With regard to the functioning of the components, reference is made to the exemplary embodiments described above and only a few differences are explained by way of example.

The decimation filter 610 can receive output signals of the analog-to-digital converter 608. Since the analog-to-digital converter 608 can sample analog signals, which it receives from the analog filter 606, with a high sampling rate, the decimation filter 610 can be provided in the present case to reduce the plurality of sampled values to a predefined value. In various embodiments, the MEMS circuit 602 can be operated with a low sampling rate, such that a low power consumption can be achieved and a small chip space requirement is needed. The interface 622 can receive a thermal X talk compensated signal 620 and can be provided as a parallel interface that can output a parallel thermal X talk compensated signal 624.

In the various embodiments described more thoroughly above, the modulator can be provided with a multi bit output.

Example 1 is as Micro-Electro-Mechanical System (MEMS) circuit. The Micro-Electro-Mechanical System (MEMS) circuit can comprise a Micro Electro Mechanical System (MEMS) device, configured to generate a MEMS signal, a control circuit, configured to detect a switched-on or switched-off state of at least one device and to generate a control signal at least partly depending on the switched-on or switched-off state, a reconstruction filter, configured to determine an interference signal which is partly generatable by the at least one device, using the generated control signal, and a subtractor, configured for subtracting the determined interference signal from the MEMS signal.

In example 2, the subject matter of claim 1 can optionally comprise the fact that the control circuit is configured to generate the control signal upon the detection or reception of the switched on state of the at least one device.

In example 3, the subject matter of either of examples 1 and 2 can optionally comprise the fact that the reconstruction filter comprises at least one amplifier.

In example 4, the subject matter of any of examples 1 to 3 can optionally comprise the fact that the reconstruction filter comprises at least one filter.

In example 5, the subject matter of example 4 can optionally comprise the fact that the filter is a second-order digital filter.

In example 6, the subject matter of either of examples 4 and 5 can optionally comprise the fact that the filter is an infinite impulse response filter (IIR filter).

In example 7, the subject matter of any of examples 4 to 6 can optionally comprise the fact that the reconstruction filter furthermore comprises a high pass filter.

In example 8, the subject matter of example 7 can optionally comprise the fact that the filter is a first order digital filter.

In example 9, the subject matter of any of examples 3 to 8 can optionally comprise the fact that the amplifier is configured to receive the control signal of the control circuit and to generate a gain adapted to the at least one device.

In example 10, the subject matter of example 9 can optionally comprise the fact that the amplifier is configured to generate a gain dependent on a power consumption of the at least one device.

In example 11, the subject matter of any of examples 4 to 10 can optionally furthermore comprise the fact that the reconstruction filter furthermore comprises a digital adaptive filter.

In example 12, the subject matter of example 11 can optionally comprise the fact that the adaptive filter is a finite impulse response filter (FIR filter).

In example 13, the subject matter of either of examples 11 and 12 can optionally comprise the fact that the adaptive filter is a first order recursive filter.

In example 14, the subject matter of either of examples 11 and 12 can optionally comprise the fact that the adaptive filter is a fourth order recursive filter.

In example 15, the subject matter of any of examples 1 to 14 can optionally comprise the fact that the Micro-Electro-Mechanical System (MEMS) device is configured as a digital microphone, wherein the circuit furthermore comprises an amplifier, configured to amplify the MEMS signal, an analog-to-digital converter, configured to receive an analog output signal of the amplifier, a digital low-pass filter, configured to receive a digital output signal of the analog-to-digital converter, and a modulator, configured to receive an output signal of the subtractor.

In example 16, the subject matter of any of examples 1 to 14 can optionally comprise the fact that the Micro-Electro-Mechanical System (MEMS) device is configured as a digital microphone, wherein the circuit furthermore comprises an amplifier, configured to amplify the MEMS signal, an analog-to-digital converter, configured to receive an analog output signal of the amplifier, a digital low-pass filter, configured to receive a digital output signal of the analog-to-digital converter, and a modulator, configured to receive an output signal of the digital low-pass filter and to provide it as the MEMS signal to the subtractor, wherein the control circuit, the reconstruction filter and the subtractor are provided externally with respect to the digital microphone.

In example 17, the subject matter of either of examples 15 and 16 can optionally comprise the fact that the output signal of the modulator is a 1-bit output.

In example 18, the subject matter of either of examples 16 and 17 can optionally comprise the fact that the analog-to-digital converter, the digital low-pass filter and the modulator are able to be sampled with a sampling rate of approximately 3 MHz, for example.

In example 19, the subject matter of any of examples 1 to 14 can optionally comprise the fact that the Micro-Electro-Mechanical System (MEMS) device is configured as an analog microphone, wherein the circuit furthermore comprises an amplifier, configured to amplify the MEMS signal, an analog-to-digital converter, configured to receive an analog output signal of the amplifier and to provide the MEMS signal to the subtractor, wherein the control circuit, the reconstruction filter, the subtractor and the analog-to-digital converter are provided externally with respect to the analog microphone.

In example 20, the subject matter of any of examples 1 to 14 can optionally comprise the fact that the Micro-Electro-Mechanical System (MEMS) device is configured as a digital microphone, wherein the circuit furthermore comprises an amplifier, configured to amplify the MEMS signal, an analog-to-digital converter, configured to receive an analog output signal of the amplifier, a decimation filter, configured to receive a digital output signal of the analog-to-digital converter and to provide an output signal to the subtractor, and an interface, configured to receive a result of the subtractor and to output a digital multi bit signal.

In example 21, the subject matter of any of examples 1 to 20 can optionally comprise the fact that the device is at least one of a sensor, a microphone, a radio frequency amplifier, a power amplifier or an antenna of a telephone.

In example 22, the subject matter of any of examples 1 to 21 can optionally comprise the fact that the switched-on or switched-off state of the at least one device is receivable from a near environment and/or from a remote environment by mans of the control circuit.

Example 23 is a method for reconstructing an interference variable. The method can comprise capturing a Micro-Electro-Mechanical System (MEMS) signal by means of a MEMS, detecting or receiving a switched-on or switched-off state of at least one device by means of a control circuit, generating a control signal by means of the control circuit at least partly depending on the switched-on or switched-off state, determining an interference signal by means of a reconstruction filter, which interference signal is partly generated by at least one device, using the generated control signal, and subtracting the determined interference signal from the MEMS signal.

In example 24, the subject matter of example 23 can optionally comprise the fact that detecting the switched-on or switched-off state comprises receiving at least one from a sensor, a microphone, a radio-frequency amplifier, a power amplifier, an antenna of a telephone.

In example 25, the subject matter of either of examples 23 and 24 can optionally comprise the fact that determining the interference signal is carried out by means of a digital circuit.

In example 26, the subject matter of any of examples 23 to 25 can optionally comprise the fact that determining the interference variable is carried out depending on capturing the switched on state by means of the control circuit.

In example 27, the subject matter of any of examples 23 to 26 can optionally comprise the fact that determining the interference variable and subtracting the determined interference signal from the MEMS signal are carried out externally on a user-side electronic circuit.

In example 28, the subject matter of any of examples 23 to 27 can optionally comprise the fact that determining the interference variable is carried out by means of at least one amplifier.

In example 29, the subject matter of example 28 can optionally comprise the fact that a gain factor of the amplifier is set depending on a power consumption of the at least one device.

In example 30, the subject matter of any of examples 23 to 29 can optionally comprise the fact that determining the interference variable is carried out by means of at least one filter.

In example 31, the subject matter of example 30 can optionally comprise the fact that determining the interference variable is carried out by means of at least one digital high pass filter.

In example 32, the subject matter of example 31 can optionally comprise the fact that determining the interference variable is carried out by means of a first order high pass filter.

In example 33, the subject matter of any of examples 30 to 32 can optionally comprise the fact that determining the interference variable is furthermore carried out by means of a second order digital filter.

In example 34, the subject matter of example 33 can optionally comprise the fact that determining the interference variable is carried out by means of an infinite impulse response filter (IIR filter).

In example 35, the subject matter of any of examples 30 to 34 can optionally comprise the fact that the determining is furthermore carried out by means of an adaptive filter in such a way that a reconstructed signal becomes adaptable to an interference variable that changes over time.

In example 36, the subject matter of example 35 can optionally comprise the fact that in the determining process the adaptive filter is realized as a finite impulse response filter (FIR filter).

In example 37, the subject matter of any of examples 23 to 36 can optionally comprise the fact that a damping of the interference signal in a range of approximately 5 dB to approximately 25 dB, of approximately 10 dB to approximately 20 dB, preferably of approximately 15 dB, is realized by means of the method.

In example 38, the subject matter of any of examples 23 to 37 can optionally comprise the fact that capturing a MEMS signal furthermore comprises amplifying the MEMS signal by means of an amplifier, converting the amplified MEMS signal into a digital signal by means of an analog-to-digital converter, filtering the digital signal by means of a digital low-pass filter, wherein subtracting involves subtracting the determined interference signal from the filtered digital signal as the MEMS signal and outputting the result by means of a modulator, for example as a 1-bit signal.

In example 39, the subject matter of any of examples 23 to 37 can optionally comprise the fact that capturing a MEMS signal furthermore comprises amplifying the MEMS signal by means of an amplifier, converting the amplified MEMS signal into a digital signal by means of an analog-to-digital converter, filtering the signal converted by means of the analog-to-digital converter by means of a low-pass filter, modulating the filtered signal by means of a modulator, wherein the modulated signal is communicated externally to a user-side electronic circuit, wherein subtracting the generated interference signal from the modulated signal as the MEMS signal is carried out externally on a user-side electronic circuit.

In example 40, the subject matter of any of examples 23 to 37 can optionally comprise the fact that the method furthermore comprises amplifying the MEMS signal by means of an amplifier, communicating the amplified signal externally to a user-side electronic circuit, converting the communicated signal into a digital signal by means of an analog-to-digital converter externally on the user-side electronic circuit, wherein subtracting is carried out externally on the user-side electronic circuit.

In example 41, the subject matter of any of examples 23 to 37 can optionally comprise the fact that the method furthermore comprises amplifying the MEMS signal by means of an amplifier, converting the amplified MEMS signal into a digital signal by means of an analog-to-digital converter, reducing a sampling rate of the digital signal by means of a decimation filter, wherein subtracting involves subtracting the determined interference signal from the digital signal having a reduced sampling rate as the MEMS signal and providing a subtraction result signal as a multi bit signal by means of an interface.

In various exemplary embodiments, a Micro-Electro-Mechanical System (MEMS) circuit can be provided which is able to capture a temperature change in an environment of the sensor and to enable a reconstruction of the temperature interference variable.

In various exemplary embodiments, an effective method and a resource-saving Micro-Electro-Mechanical System (MEMS) circuit can be realized as a result.

In various exemplary embodiments, a reconstruction filter can be provided which is applicable to a Micro Electro Mechanical System (MEMS).

In various exemplary embodiments, a X talk interference signal can be reconstructed by means of the reconstruction filter.

In various exemplary embodiments, a Micro-Electro-Mechanical System (MEMS) circuit can be provided in which a method for reconstructing an interference variable in a microphone is carried out.

In various exemplary embodiments, an interference variable can be a temperature change, i.e. a temperature increase or a temperature decrease.

In various exemplary embodiments, a Micro-Electro-Mechanical System (MEMS) circuit can be provided which comprises a MEMS device, configured to generate a MEMS signal, a control circuit, configured to detect a switched-on or switched-off state of at least one device and to generate a control signal at least partly depending on the switched-on or switched-off state, a reconstruction filter, configured to determine an interference signal which is partly generatable by the at least one device, using the generated control signal, and a subtractor, configured for subtracting the determined interference signal from the MEMS signal.

In various exemplary embodiments, the device can be for example a microphone, a pressure sensor, a gas sensor, a temperature sensor, a power amplifier or an interface.

In various exemplary embodiments, by means of a Micro-Electro-Mechanical System (MEMS) circuit and a method, a thermoacoustic effect can be reduced to a predefined range or possibly even minimized.

In various exemplary embodiments, what can be achieved is that thermal X talk is no longer acoustically perceptible.

In various exemplary embodiments, what can be achieved is that mutual influencing of electronic components as a result of a power loss in the form of heat is reduced.

In various exemplary embodiments, the control circuit can detect or receive at least one switched-on or switched-off state of one device. In various exemplary embodiments, the control circuit can detect or receive a plurality of switched on or switched off states of a plurality of devices. In various exemplary embodiments, information about a switched-on or switched-off state of a plurality of devices can be detected or received successively or partly simultaneously by the control circuit.

In various exemplary embodiments, the control circuit can be configured also to generate a control signal independently of a switched-on or switched-off state of an external device, by means of which control signal a reconstruction of an interference signal can be instigated. In this regard, by way of example, the control circuit can be configured to generate the control signal even if a transition from a switched on state to a switched off state of an external device was detected by means of the control circuit. In this regard, by way of example, after deactivation of at least one external device, the control circuit can be configured to generate the control signal in order to be able to carry out a compensation of a temperature change during a cooling process of the at least one sensor to a predefined temperature.

Furthermore, the control circuit can be configured for example to detect a temperature in an environment of a sensor or a temperature of at least one sensor by means of a temperature measuring probe.

In various exemplary embodiments, a X talk noise signal can be reconstructed and subtracted from a MEMS measurement signal.

In various exemplary embodiments, the control circuit can be configured to generate the control signal upon the detection of the switched on state of the at least one device.

In various exemplary embodiments, a Micro-Electro-Mechanical System (MEMS) circuit can be provided in which, for a reconstruction of an interference variable, power is only consumed if an interference variable is captured beforehand.

In various exemplary embodiments, what can be achieved is that power consumption can be reduced or possibly minimized. Since the reconstruction can be carried out when a further device, for example a sensor, remains switched on, the energy consumption of the system can be reduced during the time in which no sensor is switched on, as a result of not carrying out the reconstruction. A continuous power consumption can thus be dispensed with.

In various exemplary embodiments, what can be achieved is that the reconstruction filter can be activated only upon the registration of a further device in operation, for example an antenna, a power amplifier, one sensor or a plurality of sensors. In a case where no further device is operated, that is to say an interference variable, for example a temperature change, is not generated, the reconstruction filter can consume no or only a low power consumption. Consequently, a power consumption can be reduced or possibly even minimized.

In various exemplary embodiments, the reconstruction filter can comprise at least one amplifier.

In various exemplary embodiments, the amplifier can be specified by means of the term "gain factor" or "gain". By means of the amplifier, an input signal, for example a voltage, can be amplified by a gain factor, that is to say that the power of the input signal can be increased (by the gain factor). To put it another way, the gain represents the amplification of a variable output quantity relative to a variable input quantity according to an unambiguous and proportional relationship. Upon the power of an amplifier being increased, it is possible to realize an increase in the power of the output signal. This may necessitate an additional power, which can be fed by means of an energy feed, for example via an energy supply.

In various exemplary embodiments, what can be achieved is that, by means of the amplifier, a power consumption of a device that generates an interference variable can be digitally mapped in the reconstruction filter. In general, the power consumption may depend on the device that is switched on or off.

In various exemplary embodiments, the reconstruction filter can comprise at least one filter.

In various exemplary embodiments, the filter can be or comprise a second-order digital filter. However, the filter can also be or comprise a third-order filter, fourth-order filter or even higher-order filter. However, the filter can also be or comprise a first-order filter.

In various embodiments, the digital filter can be described by the equation:

$$Hth = \frac{b_0 + b_1 z^{-1} + b_2 z^{-2}}{1 + a_1 z^{-1} + a_2 z^{-2}}$$

In various exemplary embodiments, the filter can be an infinite impulse response filter (IIR filter).

In various exemplary embodiments, a filter having a low filter order, a low complexity and having a short time delay can be realized.

The reconstruction filter can furthermore comprise a high pass filter.

The digital filter can for example be or comprise a first order high pass filter and be described by the equation:

$$Hhp = \frac{b_{hp0} - b_{hp1} z^{-1}}{1 + a_{hp1} z^{-1}}$$

The filter can be or comprise a first order digital filter.

The amplifier can be configured to receive the control signal of the control circuit and to generate a gain adapted to the at least one device.

In various exemplary embodiments, what can be achieved is that the amplifier is only operated if a control signal is present at it.

The amplifier can be configured to generate a gain dependent on a power consumption of the at least one device.

The amplifier can have a constant gain factor or adaptively adapt the gain factor to a power consumption or a power loss of at least one device. The amplifier can increase or decrease the gain factor, if for example a power loss of a device increases or decreases.

The reconstruction filter can furthermore comprise a digital adaptive filter.

The adaptive filter can have a low complexity.

In various exemplary embodiments, what can be achieved is that a high adaptability of the MEMS circuit to interference variables that change over time is made possible.

The adaptive filter can be used to compensate for component variations, for example cut off frequency tolerances of filters or package dependent variations.

In various exemplary embodiments, the performance of the system can be increased by means of the adaptive filter.

In various exemplary embodiments, what can be achieved is that an adaptation to changing conditions with regard to the device causing the interference variable, for example switching on of a further device, is made possible.

By way of example, it is possible for one device to be operated which generates one interference variable; it is also possible for a plurality of devices to be operated which in total generate another interference variable. The adaptive filter can make it possible to adapt the method to the changing conditions.

The adaptive filter can be a finite impulse response filter (FIR filter).

The adaptive filter can be described by the equation:

$$\mathrm{Fir}=c_0+c_1 z^{-1}$$

It is possible to realize a filter having a linear phase response which is tolerant vis-à-vis quantization effects.

The adaptive filter can be or comprise a first order recursive filter.

However, the adaptive filter can also be or comprise a higher-order recursive filter, for example a second-order or third-order recursive filter or a fourth-order or even higher-order recursive filter.

The adaptive filter can comprise a variable filter component and can be variable in accordance with a predefined update algorithm.

In various exemplary embodiments, the use of a fourth order (for example recursive) filter makes it possible to achieve an improved reconstruction of an interference signal in comparison with a lower order filter.

The reconstruction filter can comprise an amplifier, a second-order digital filter, a first order high pass filter and an adaptive FIR filter.

In various exemplary embodiments, the MEMS device can be configured as a digital microphone, wherein the circuit furthermore comprises an amplifier, configured to amplify the MEMS signal, an analog-to-digital converter, configured to receive an analog output signal of the amplifier, a digital low-pass filter, configured to receive a digital output signal of the analog-to-digital converter, and a modulator, configured to receive an output signal of the subtractor.

In various exemplary embodiments, the MEMS can provide a measurement signal, for example an analog measurement signal. The measurement signal is fed to an amplifier, which is realized for example as a voltage follower, as an input signal. The amplifier can comprise for example a voltage follower. The amplifier amplifies the output signal of the MEMS. The output signal of the amplifier is fed to an analog-to-digital converter, which carries out a digitization of the output signal of the amplifier. The digitized signals are provided as an input signal to a digital low-pass filter. The digital low-pass filter filters high frequencies out of the signals and allows low frequencies to pass. The control circuit outputs a signal to the reconstruction filter if for example at least one item of information about an activity and/or operation and/or an on/off signal of at least one device are registered. The control signal of the control circuit can activate the reconstruction filter, such that the reconstruction filter can begin the reconstruction of the interference signal. If the interference signal is available at an output of the reconstruction filter, the reconstructed signal can be taken away or subtracted from the signal that can be output by the digital low-pass filter. The subtraction result can be provided to a modulator, also called mixer, which can represent a user or customer specific output interface.

In various embodiments, the modulator can be provided with a multi bit output.

In various exemplary embodiments, the control circuit can detect or receive internal and/or external information. Internal information can comprise for example information about a switched-on or switched-off state of a further sensor. External information can comprise for example information about a switched-on or switched-off state of a radio frequency amplifier.

In various exemplary embodiments, an analog-to-digital converter, also referred to as an A/D converter or (ADC), can be provided so as to convert analog input signals into a digital data stream. An analog-to-digital converter can discretize a time continuous input signal into individual discrete samples either by means of its functional principle or by means of an upstream or integrated sample and hold stage. Digital values are assigned to the samples. On account of a finite number of possible output values, a quantization can be effected here.

In various exemplary embodiments, the amplifier can be or comprise for example a voltage follower or source follower or common-drain connection. The voltage follower can comprise an analog basic circuit and can be realized by means of field effect transistors, for example. The voltage follower as a selected circuit can have the advantage that a supplying voltage source for the input signal has no resistance and the input impedance can be high. The amplifier can be provided to load the input voltage as little as possible. An input resistance of the amplifier can be provided with a high value.

The digital low-pass filter can be provided to filter high frequency signals out of a signal provided by an analog-to-digital converter and to allow only low frequencies below a predefinable cut off frequency to pass.

In various exemplary embodiments, a modulator having a clock rate in a range of approximately 1 MHz to approximately 4 MHz, for example of approximately 1.5 MHz to approximately 3 MHz, can be provided. In various exemplary embodiments, the modulator can superimpose a plurality of signals.

An analog microphone having an analog output can also be provided instead of a digital microphone having a digital output.

The MEMS, the amplifier, the analog-to-digital converter, the digital low-pass filter, the control circuit, the reconstruction filter, the subtractor and the modulator can be provided in the digital microphone.

The Micro-Electro-Mechanical System (MEMS) device can be configured as a digital microphone, wherein the circuit can furthermore comprise an amplifier, configured to amplify the MEMS signal, an analog-to-digital converter, configured to receive an analog output signal of the amplifier, a digital low-pass filter, configured to receive a digital output signal of the analog-to-digital converter, and a modulator, configured to receive an output signal of the digital low-pass filter and to provide it as the MEMS signal to the subtractor, wherein the control circuit, the reconstruction filter and the subtractor are provided externally with respect to the digital microphone.

In various exemplary embodiments, a reconstruction of an interference variable can be carried out on the user side, i.e. for example not in the sensor, but rather sensor-externally, or to put it another way in a user-side electronic circuit. An electronic circuit for reconstructing the interference variable can thus be provided sensor externally and can be coupled to the sensor or the sensors for example by means of a wired or wireless data transmission.

In various exemplary embodiments, the output signal of the modulator can be coupled to the subtractor of the sensor-external electronic circuit by means of an electrical line, by means of a contact or by means of a wireless connection. In various exemplary embodiments, the control circuit can for example optionally receive information from the digital microphone for example by means of a wired or wireless data transmission. Furthermore, the control circuit can be configured to generate a control signal independently of a detected switched-on or switched-off state of at least one device.

In various exemplary embodiments, the sensor external electronic circuit can comprise an electronic component group, which can be electrically coupled for example to the Micro-Electro-Mechanical System (MEMS) circuit. In various exemplary embodiments, information can be communicated from the sensor-external electronic circuit to the Micro-Electro-Mechanical System (MEMS) circuit, and vice versa.

In various exemplary embodiments, the MEMS, the amplifier, the analog-to-digital converter, the digital low-pass filter, the control circuit, the reconstruction filter, the subtractor and the modulator can be realized in the digital microphone.

In various exemplary embodiments, the sensor external electronic circuit can be arranged externally with respect to the microphone. Illustratively, by way of example, a customer can in turn provide electronic components connected to the MEMS or the Micro-Electro-Mechanical System (MEMS) circuit in a wired or wireless fashion.

The output signal of the modulator can be a 1-bit output. In various exemplary embodiments, the modulator can process for example one bit at the same time. Alternatively, the output signal of the modulator can be a multi bit output signal. In various exemplary embodiments, the modulator can process for example a plurality of bits at the same time, i.e. in parallel.

In various exemplary embodiments, the analog-to-digital converter, the digital low-pass filter and the modulator can be able to be sampled with a sampling rate of approximately 3 MHz.

In various exemplary embodiments, the MEMS device can be configured as an analog microphone, wherein the circuit furthermore comprises an amplifier, configured to amplify the MEMS signal, an analog-to-digital converter, configured to receive an analog output signal of the amplifier and to provide the MEMS signal to the subtractor, wherein the control circuit, the reconstruction filter, the subtractor and the analog-to-digital converter are provided externally with respect to the analog microphone (to put it another way microphone-externally).

In various exemplary embodiments, the amplifier can comprise a voltage follower or be a voltage follower. The amplifier can communicate for example an analog output signal to the analog-to-digital converter in a wired or wireless manner. In various exemplary embodiments, the MEMS and the amplifier can be realized in an analog microphone, and the analog-to-digital converter, the control circuit, the reconstruction filter and the subtractor can be realized microphone externally.

In various exemplary embodiments, the MEMS and the amplifier can be realized in an analog microphone.

The reconstruction of the X talk can be realized outside the digital microphone.

In various exemplary embodiments, a low sampling rate can be realized, which leads to a low power consumption and a smaller space requirement on a chip.

The Micro Electro Mechanical System (MEMS) device can be configured as a digital microphone, wherein the circuit furthermore comprises an amplifier, configured to amplify the MEMS signal, an analog-to-digital converter, configured to receive an analog output signal of the amplifier, a decimation filter, configured to receive a digital output signal of the analog-to-digital converter and to provide an output signal to the subtractor, and an interface, configured to receive a result of the subtractor and to output a digital multi bit signal.

By means of the decimation filter, the high sampling rate of the analog-to-digital converter can be reduced to a lower sampling rate, such that a lower power consumption and a smaller chip area can be achieved.

In various exemplary embodiments, the MEMS, the amplifier, the analog-to-digital converter, the decimation filter, the control circuit, the reconstruction filter, the subtractor and the interface can be realized on the digital microphone.

In various exemplary embodiments, a decimation filter can be provided which can be connected downstream of an analog-to-digital converter and allows only a smaller quantity of digital data signals from the incoming larger quantity of digital data signals of the analog-to-digital converter to pass by means of down sampling.

In various exemplary embodiments, the decimation filter can comprise a digital low-pass filter, wherein a band limiting can take place by means of the low pass filtering. The decimation filter can have a factor which can indicate a ratio between the input clock frequency and the output clock frequency. The input clock frequency can be higher than the output clock frequency.

The interface can provide for example a word width of one byte, comprising 8 bits, or a word width of 16 bits, etc., as output signal.

The interface can receive a 1-bit signal 8 times serially in succession at a signal input and temporarily buffer or temporally store these 8 signals and simultaneously provide one byte in parallel at the output of the interface. The interface, in this case for example comprising a serial-to parallel converter, is not restricted to the word widths mentioned; in principle, any desired word width can be realized.

In various exemplary embodiments, the device can be at least one of a sensor, a microphone, a radio-frequency amplifier, a power amplifier or an antenna of a telephone. In various exemplary embodiments, the device can be any electronic component which can generate a power loss in the form of heat.

In various exemplary embodiments, what can be achieved is that in an arrangement of a plurality of sensors which are arranged for example alongside one another in a housing, mutual influencing of the respective sensor output signals can be avoided. Since more and more sensors are being accommodated together in a housing, it is advantageous if mutual influencing of the sensors among one another can be avoided or kept within a specific range. Furthermore, in various exemplary embodiments, interference influences on a sensor in a MEMS for example from an antenna in a mobile telephone, a smartphone, or a tablet, can be reduced, possibly minimized.

In various exemplary embodiments, a plurality of sensors can be integrated in a housing or package.

By virtue of the reconstruction of X talk, a plurality of sensors can be accommodated close together in a package.

The switched-on or switched-off state of the at least one device can be receivable from a near environment and/or from a remote environment by mans of the control circuit.

In various exemplary embodiments, a method for reconstructing an interference variable is provided. The method comprises capturing a Micro Electro Mechanical System (MEMS) signal by means of a MEMS, detecting a switched-on or switched-off state of at least one device by means of a control circuit, generating a control signal by means of the control circuit at least partly depending on the switched-on or switched-off state, determining an interference signal by means of a reconstruction filter, which interference signal is partly generated by at least one device, using the generated control signal, and subtracting the determined interference signal from the MEMS signal.

In various exemplary embodiments, generating the control signal by means of the control circuit can be generated independently of the switched-on or switched-off state.

In various exemplary embodiments, detecting the switched-on or switched-off state can comprise receiving at least one from a sensor, a microphone, a radio frequency amplifier, a power amplifier, an antenna of a telephone.

Determining the interference signal can be carried out by means of a digital circuit.

In various exemplary embodiments, a high flexibility, adaptability and simplicity can be achieved by means of the use of digital signals. The flexibility can reside for example in the fact that a digital filter can be modeled by a data set which can be changed in a relatively simple manner, without the need to make changes to hardware.

Determining the interference variable can be carried out depending on capturing the switched on state by means of the control circuit.

Furthermore, a MEMS circuit can be provided which is distinguished by a low power consumption when carrying out a method for reconstructing an interference signal.

Determining the interference variable and subtracting the determined interference signal from the MEMS signal can be carried out externally on a user-side electronic circuit or sensor-externally (for example also MEMS externally).

Determining the interference variable can be carried out by means of at least one amplifier.

Furthermore, a gain factor of the amplifier can be set depending on a power consumption of the at least one device.

Furthermore, the amplifier can be configured to receive the control signal of the control circuit and to generate a gain adapted to the at least one device.

The amplifier can be configured to generate a gain dependent on a power consumption of the at least one device.

The amplifier can have a gain factor which can be dependent on the respective device. In this regard, in various exemplary embodiments, by way of example, a gain factor of an amplifier can be high in the case of a device having a high power consumption. Furthermore, a gain factor of an amplifier can be low in the case of a device having a low power consumption.

Determining the interference variable can be carried out by means of at least one filter.

In various exemplary embodiments, determining the interference variable can be carried out by means of at least one digital high pass filter.

In various exemplary embodiments, the high pass filter can have a variation of a cut off frequency of approximately 10%, for example. In this case, the X talk damping can be approximately 30 dB, for example.

Determining the interference variable can be carried out by means of a first order high pass filter.

Determining the interference variable can furthermore be carried out by means of a second order digital filter.

In various exemplary embodiments, determining the interference variable can be carried out by means of an infinite impulse response filter (IIR filter).

In various exemplary embodiments, determining can furthermore be carried out by means of an adaptive filter in such a way that a reconstructed signal becomes adaptable to an interference variable that changes over time.

In various exemplary embodiments, in the determining process, the adaptive filter can be realized as a finite impulse response filter (FIR filter).

In various exemplary embodiments, a damping of the interference signal in a range of approximately 5 dB to approximately 25 dB, of approximately 10 dB to approximately 20 dB, preferably of approximately 15 dB, can be realized by means of the method.

In various exemplary embodiments, capturing a MEMS signal furthermore comprises amplifying the MEMS signal by means of an amplifier, converting the amplified MEMS signal into a digital signal by means of an analog-to-digital converter, filtering the digital signal by means of a digital low-pass filter, wherein subtracting involves subtracting the determined interference signal from the filtered digital signal as the MEMS signal and outputting the result by means of a modulator, for example as a 1-bit signal.

In various exemplary embodiments, capturing a MEMS signal can furthermore comprise amplifying the MEMS signal by means of an amplifier, converting the amplified MEMS signal into a digital signal by means of an analog-to-digital converter, filtering the signal converted by means of the analog-to-digital converter by means of a low-pass filter, modulating the filtered signal by means of a modulator, wherein the modulated signal is communicated to a user-side electronic circuit, wherein subtracting the generated interference signal from the modulated signal as the MEMS signal is carried out externally on a user-side electronic circuit.

In various exemplary embodiments, the analog-to-digital converter, the digital low-pass filter and the modulator can be sampled by means of a sampling rate. In various exemplary embodiments, the sampling rate can be for example in a range of approximately 2 MHz to approximately 4 MHz, preferably approximately 3 MHz.

In various exemplary embodiments, the method can furthermore comprise amplifying the MEMS signal by means of an amplifier, communicating the amplified signal to a sensor external (for example MEMS external) electronic circuit, converting the communicated signal into a digital signal by means of an analog-to-digital converter externally on a user-side electronic circuit, wherein subtracting is carried out externally on the user-side electronic circuit (for example sensor externally or MEMS externally).

In various exemplary embodiments, the method can furthermore comprise amplifying the MEMS signal by means of an amplifier, converting the amplified MEMS signal into a digital signal by means of an analog-to-digital converter, reducing a sampling rate of the digital signal by means of a decimation filter, wherein subtracting involves subtracting the determined interference signal from the digital signal having a reduced sampling rate as the MEMS signal and providing a subtraction result signal as a multi bit signal by means of an interface.

In various exemplary embodiments, an interference signal of a power amplifier, for example a temperature change on account of the power amplifier being switched on or off, can be simulated by means of the reconstruction filter. The measurement signal on which the interference signal can be superimposed can be purged by subtracting the simulated signal.

In various exemplary embodiments, a method can be provided in which capturing the information comprises capturing internal information regarding a switched-on or switched-off state of at least one sensor or radio frequency amplifier.

In various exemplary embodiments, a method can be provided in which capturing the information comprises capturing external information regarding a switched-on or switched-off state of a radio frequency amplifier or of a microphone.

In various exemplary embodiments, a method can be provided in which capturing the information comprises capturing a switched-on or switched-off state of components which are arranged around a MEMS or ASIC.

In various exemplary embodiments, a method can be provided by means of which an improved measurement accuracy of a sensor can be achieved.

In various exemplary embodiments, the method can be carried out at least partly sensor externally (for example on the user side), i.e. for example on a side provided by a customer.

In various exemplary embodiments, a method can be provided in which the reconstruction is realized by means of an amplifier and at least one filter.

In various exemplary embodiments, a method can be provided in which reconstructing the interference signal involves realizing a second-order digital infinite impulse response filter (IIR filter) and a high pass filter as a first order high-pass filter.

In various exemplary embodiments, a method can be provided in which the reconstruction is furthermore realized by means of an adaptive filter in such a way that a reconstructed signal is adapted to a changing interference variable. A changing interference variable can be for example an interference variable that changes over time.

In various exemplary embodiments, a method can be provided in which the adaptive filter is adaptable to the respective interference variable conditions or can have the property of being able automatically to change its transfer function during operation.

In various exemplary embodiments, a method can be provided in which the filter coefficients of the adaptive filter are able to be changed according to predefined (and stored) rules.

Further advantageous configurations of the method are evident from the description of the MEMS circuit, and vice versa.

The properties and advantages described herein can relate to the micro electro mechanical system and to the method.

Although illustrative embodiments have been shown and described primarily with reference to specific exemplary embodiments, it should be understood by those familiar with the technical field that numerous modifications can be made thereto regarding configuration and details, without departing from the essence and scope of the invention as defined by the following claims. The scope of the invention is therefore determined by the appended claims, and the intention is to encompass all modifications which come under the literal meaning or fall within the range of equivalence of the claims.

What is claimed is:

1. A Micro Electro Mechanical System (MEMS) circuit, comprising:

a MEMS device configured to generate a MEMS signal;

a control circuit configured to detect a switched-on state or switched-off state of at least one device thermally coupled to the MEMS device and configured to generate a control signal indicating the switched-on state or the switched-off state of the at least one device, wherein a temperature change in the at least one device causes the MEMS device to produce a corresponding thermal interference signal;

a reconstruction filter having an input coupled to the control circuit, the reconstruction filter configured to estimate the thermal interference signal in response to the generated control signal; and a subtractor configured to subtract the estimated thermal interference signal from the MEMS signal.

2. The circuit as claimed in claim 1, wherein the control circuit is configured to generate the control signal upon the detection of the switched-on state of the at least one device.

3. The circuit as claimed in claim 1, wherein the reconstruction filter comprises at least one amplifier;

wherein the reconstruction filter comprises at least one filter; and wherein the filter is a second-order digital filter.

4. The circuit as claimed in claim 3, wherein the amplifier is configured to receive the control signal of the control circuit and apply a gain to the control signal;

wherein the gain is adapted to the at least one device; and wherein the amplifier is configured to generate the gain dependent on a power consumption of the at least one device.

5. The circuit as claimed in claim 1, wherein the reconstruction filter furthermore comprises a high pass filter; and wherein the high pass filter is a first order digital filter.

6. The circuit as claimed in claim 1, wherein the reconstruction filter further comprises a digital adaptive filter;

wherein the adaptive filter is a finite impulse response filter (FIR filter); and wherein the adaptive filter is a first order recursive filter.

7. The circuit as claimed in claim 1, wherein the MEMS device is configured as a digital microphone; and wherein the circuit furthermore comprises an amplifier, configured to amplify the MEMS signal, an analog-to-digital converter configured to receive an analog output signal of the amplifier, a digital low-pass filter configured to receive a digital output signal of the analog-to-digital converter, and a modulator configured to receive an output signal of the subtractor.

8. The circuit as claimed in claim 7, wherein the output signal of the modulator is a 1-bit output.

9. The circuit as claimed in claim 1, wherein the MEMS device is configured as a digital microphone; and wherein the circuit furthermore comprises:

an amplifier, configured to amplify the MEMS signal, an analog-to-digital converter, configured to receive an analog output signal of the amplifier, a digital low-pass filter, configured to receive a digital output signal of the analog-to-digital converter, and a modulator, configured to receive an output signal of the digital low-pass filter and to provide it as the MEMS signal to the subtractor, wherein the control circuit, the reconstruction filter and the subtractor are provided on a user-side electronic circuit that is external to the digital microphone.

10. The circuit as claimed in claim 1, wherein the MEMS device is configured as an analog microphone, and wherein the circuit furthermore comprises:

an amplifier, configured to amplify the MEMS signal; and an analog-to-digital converter, configured to receive an analog output signal of the amplifier and to provide the MEMS signal to the subtractor, wherein the control circuit, the reconstruction filter, the subtractor and the analog-to-digital converter are external to the analog microphone.

11. The circuit as claimed in claim 1, wherein the MEMS device is configured as a digital microphone, and wherein the circuit furthermore comprises:

an amplifier, configured to amplify the MEMS signal;

an analog-to-digital converter, configured to receive an analog output signal of the amplifier;

a decimation filter, configured to receive a digital output signal of the analog-to-digital converter and to provide an output signal to the subtractor; and an interface, configured to receive a result of the subtractor and to output a digital multi-bit signal.

12. The circuit as claimed in claim 1, wherein the device is at least one of a sensor, a microphone, a radio frequency amplifier, a power amplifier or an antenna of a telephone.

13. The circuit as claimed in claim 1, wherein the switched-on or switched-off state of the at least one device is configured to be received from a near environment and/or from a remote environment by the control circuit.

14. A method for reconstructing an interference variable, comprising:

capturing a Micro Electro Mechanical System (MEMS) signal using a MEMS;

detecting a switched-on state or a switched-off state of at least one device thermally coupled to the MEMS device using a control circuit;

generating a control signal using the control circuit, wherein the control signal indicates the switched-on state or switched-off state of the at least one device, and a temperature change in the at least one device causes the MEMS device to produce a corresponding thermal interference signal;

estimating the thermal interference signal using a reconstruction filter in response to the generated control signal, wherein the estimated thermal interference signal models interference generated by at least one device; and subtracting the estimated thermal interference signal from the MEMS signal.

15. The method as claimed in claim 14, wherein detecting the switched-on state or the switched-off state comprises detecting a state of at least one of a sensor, a microphone, a radio frequency amplifier, a power amplifier, or an antenna of a telephone.

16. The method as claimed in claim 14, wherein estimating the thermal interference signal comprises using a digital circuit.

17. The method as claimed in claim 14, wherein estimating the thermal interference signal further comprises capturing the switched-on state using the control circuit.

18. The method as claimed in claim 14, wherein estimating the thermal interference signal and subtracting the estimated thermal interference signal from the MEMS signal are performed externally on a user-side electronic circuit.

19. The method as claimed in claim 14, wherein estimating the thermal interference signal comprises using at least one amplifier; and wherein a gain factor of the at least one amplifier is set depending on a power consumption of the at least one device.

20. The method as claimed in claim 14, wherein estimating the thermal interference signal comprises using at least one filter.

21. The method as claimed in claim 14, wherein capturing a MEMS signal further comprises:

amplifying the MEMS signal using an amplifier;

converting the amplified MEMS signal into a digital signal using an analog-to-digital converter; and filtering the digital signal using a digital low-pass filter, wherein subtracting comprises subtracting the estimated thermal interference signal from the filtered digital signal to form a result, and modulating the result using a modulator to produce a 1-bit signal.

22. The method as claimed in claim 14, wherein capturing a MEMS signal further comprises:

amplifying the MEMS signal using an amplifier;

converting the amplified MEMS signal into a digital signal using an analog-to-digital converter to form the digital signal;

filtering the digital signal using a low-pass filter to form a filtered signal;

modulating the filtered signal using modulator to form a modulated signal; and communicating the modulated signal externally to a user-side electronic circuit, wherein subtracting comprises subtracting the estimated thermal interference signal from the modulated signal, and the subtracting is performed externally on the user-side electronic circuit.

23. The method as claimed in claim 14, wherein the method further comprises:

amplifying the MEMS signal using an amplifier;

communicating the amplified signal externally to a user-side electronic circuit; and converting the communicated amplified signal into a digital signal using an analog-to-digital converter externally on the user-side electronic circuit, wherein subtracting is performed externally on the user-side electronic circuit.

24. The method as claimed in claim 14, wherein the method further comprises:

amplifying the MEMS signal using an amplifier;

converting the amplified MEMS signal into a digital signal using an analog-to-digital converter; and reducing a sampling rate of the digital signal using a decimation filter to form a reduced sample rate signal, wherein subtracting comprises subtracting the estimated thermal interference signal from the reduced sample rate signal and providing a subtraction result signal as a multi-bit signal via an interface.

* * * * *